US011040256B2

(12) United States Patent
Milleman et al.

(10) Patent No.: US 11,040,256 B2
(45) Date of Patent: Jun. 22, 2021

(54) MULTICOMPONENT WEIGHT SYSTEM FOR A GOLF CLUB HEAD

(71) Applicant: KARSTEN MANUFACTURING CORPORATION, Phoenix, AZ (US)

(72) Inventors: Travis D. Milleman, Portland, OR (US); Cory S. Bacon, Cave Creek, AZ (US); Les Bryant, Peoria, AZ (US); David A. Higdon, Cave Creek, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 16/813,484

(22) Filed: Mar. 9, 2020

(65) Prior Publication Data

US 2020/0206588 A1 Jul. 2, 2020

Related U.S. Application Data

(63) Continuation of application No. 16/113,956, filed on Aug. 27, 2018, now Pat. No. 10,617,916.

(60) Provisional application No. 62/550,363, filed on Aug. 25, 2017.

(51) Int. Cl.
*A63B 53/04* (2015.01)

(52) U.S. Cl.
CPC ..... *A63B 53/0466* (2013.01); *A63B 53/0408* (2020.08); *A63B 53/0412* (2020.08); *A63B 53/0433* (2020.08); *A63B 53/0437* (2020.08); *A63B 2053/0491* (2013.01)

(58) Field of Classification Search
CPC ..... A63B 53/0466; A63B 53/0412; A63B 53/0437; A63B 53/0433; A63B 53/0408; A63B 2053/0491
USPC ..... 473/334
See application file for complete search history.

(56) References Cited

U.S. PATENT DOCUMENTS

| | | | | |
|---|---|---|---|---|
| 1,485,685 | A | 3/1924 | Alexander | |
| 2,257,575 | A | 9/1941 | Reach | |
| 5,429,356 | A | 7/1995 | Dingle | |
| 6,379,265 | B1 | 4/2002 | Hirakawa et al. | |
| 7,294,065 | B2 | 11/2007 | Liang et al. | |
| 7,824,280 | B2 | 11/2010 | Yokota | |
| 8,550,933 | B2 | 10/2013 | Demkowski et al. | |
| 8,696,491 | B1 | 4/2014 | Myers | |
| 8,894,506 | B1 | 11/2014 | Myers et al. | |
| 9,084,921 | B1 | 7/2015 | Liang et al. | |
| 9,155,945 | B2 | 10/2015 | Demkowski et al. | |
| 9,199,145 | B1 | 12/2015 | Myers | |
| 9,265,994 | B2 * | 2/2016 | Mizutani | A63B 53/0466 |
| 9,387,376 | B1 | 7/2016 | Hall et al. | |
| 9,415,280 | B2 | 8/2016 | Stokke et al. | |
| 9,433,836 | B2 | 9/2016 | Breier et al. | |

(Continued)

FOREIGN PATENT DOCUMENTS

| | | |
|---|---|---|
| JP | 2009112570 | 5/2009 |
| KR | 20020080627 | 10/2002 |
| WO | 2015013667 | 1/2015 |

*Primary Examiner* — William M Pierce

(57) ABSTRACT

The present invention is a golf club head containing a multicomponent weight system comprising a weight member, a cap, and a fastener. The weight member comprises of an upper surface, side surface, one or more splines, one or more slits, an aperture, and one or more bores. The cap comprises an aperture and at least one post. The fastener comprises a head portion and body portion.

17 Claims, 4 Drawing Sheets

(56) References Cited

U.S. PATENT DOCUMENTS

| | | | | |
|---|---|---|---|---|
| 9,744,415 | B2 | 8/2017 | Frame et al. | |
| 9,764,210 | B2 | 9/2017 | Curtis et al. | |
| 9,776,060 | B2 | 10/2017 | Hall et al. | |
| 9,931,551 | B2 | 4/2018 | Mizutani | |
| 9,975,019 | B2 | 5/2018 | Frame et al. | |
| 9,987,525 | B2 | 6/2018 | Stokke et al. | |
| 2011/0143858 | A1 | 6/2011 | Peralta | |
| 2012/0122601 | A1 | 5/2012 | Beach | |
| 2012/0172142 | A1 | 7/2012 | Yashiki | |
| 2012/0202617 | A1 | 8/2012 | Rice | |
| 2014/0235369 | A1 | 8/2014 | Willett | |
| 2017/0173413 | A1 | 6/2017 | Cleghorn et al. | |
| 2018/0021641 | A1 | 1/2018 | Hall et al. | |
| 2018/0200590 | A1* | 7/2018 | Evans | A63B 53/06 |
| 2019/0134472 | A1 | 5/2019 | Stokke | |

* cited by examiner

MULTICOMPONENT WEIGHT SYSTEM FOR A GOLF CLUB HEAD

CROSS-REFERENCE TO RELATED APPLICATIONS

This is a continuation of U.S. patent application Ser. No. 16/113,956, filed on Aug. 27, 2018, which claims the benefit of U.S. Provisional Patent Appl. No. 62/550,363, filed on Aug. 25, 2017, the contents of which are incorporated fully herein by reference.

FIELD OF INVENTION

This disclosure relates generally to golf clubs and relates more particularly to golf club heads with an attachable swing weight system.

BACKGROUND

Weighting of low lofted golf club heads (e.g. drivers, fairway woods, and hybrids) is an important design consideration for club head performance. Many current club head weighting systems are bulky, complex, and lend themselves to significant wear and tear due to repeated use and playing conditions (e.g. water damage from rain or dew). There is a need in the art for a weighting system that reduces bulk, complexity, and wear.

BRIEF DESCRIPTION OF THE DRAWINGS

To facilitate further description of the embodiments, the following drawings are provided in which.

Figure 1:
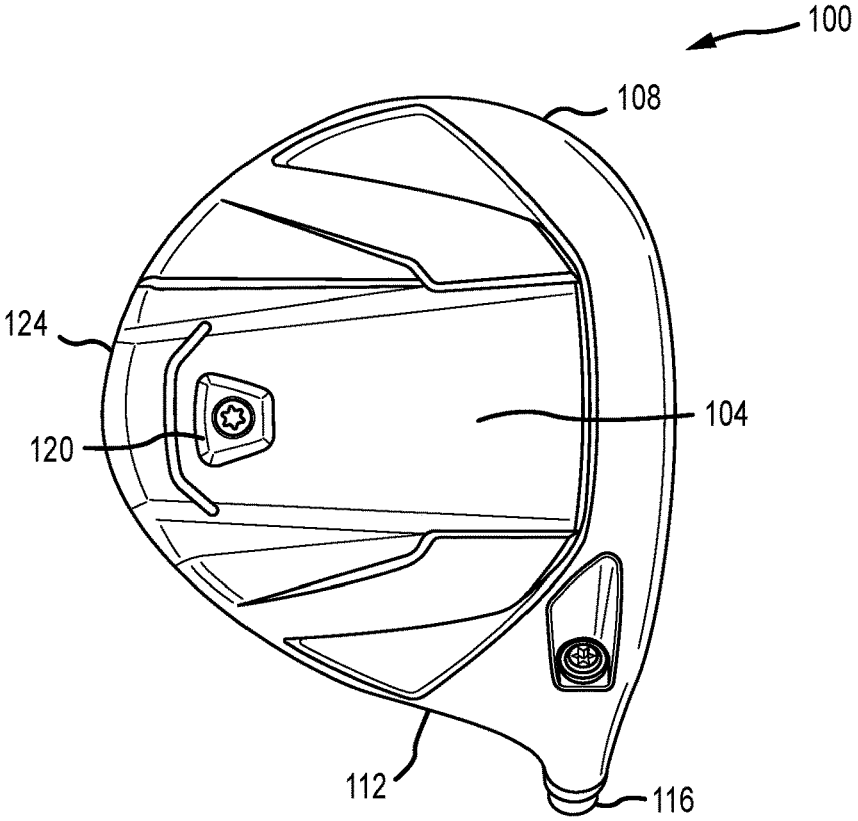
FIG. 1 illustrates an embodiment of a golf club head having a multicomponent weight system.

Other aspects of the disclosure will become apparent by consideration of the detailed description and accompanying drawings.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

DETAILED DESCRIPTION

Described herein is a golf club head having a multicomponent weight system to adjust the weight of the club head.

The weight system comprises a weight having a trapezoidal shape. The weight is located near a rear of the club head, for optimal weight distribution of the club head. Further, the weight system can comprise a cap to improve the security of the weight within the cavity and to provide a tighter securing force on the base of the cavity to aid in water resistance and improve durability. Further still, the weight system can further comprise ribs, slits, and splines, to improve alignment and fit, without the need for tight manufacturing tolerances, thereby reducing manufacturing cost, improving ease of manufacturing and installation.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

FIG. 1-7 illustrate an embodiment of a golf club head 100 having a multicomponent weight system 120. In many embodiments, the golf club head 100 can comprise a wood-type club head (e.g. driver, fairway wood, or hybrid). In other embodiments, the golf club head 100 can include other types of club heads.

In some embodiments, the club head 100 can comprise a driver. In these embodiments, the loft angle of the club head 100 can be less than approximately 16 degrees, less than approximately 15 degrees, less than approximately 14 degrees, less than approximately 13 degrees, less than approximately 12 degrees, less than approximately 11 degrees, or less than approximately 10 degrees. Further, in these embodiments, the volume of the club head 100 can be greater than approximately 400 cc, greater than approximately 425 cc, greater than approximately 450 cc, greater than approximately 475 cc, greater than approximately 500 cc, greater than approximately 525 cc, greater than approximately 550 cc, greater than approximately 575 cc, greater than approximately 600 cc, greater than approximately 625 cc, greater than approximately 650 cc, greater than approximately 675 cc, or greater than approximately 700 cc. In some embodiments, the volume of the club head 100 can be approximately 400 cc-600 cc, 425 cc-500 cc, approximately 500 cc-600 cc, approximately 500 cc-650 cc, approximately 550 cc-700 cc, approximately 600 cc-650 cc, approximately 600 cc-700 cc, or approximately 600 cc-800 cc.

In some embodiments, the club head 100 can comprise a fairway wood. In these embodiments, the loft angle of the club head 100 can be less than approximately 35 degrees, less than approximately 34 degrees, less than approximately 33 degrees, less than approximately 32 degrees, less than approximately 31 degrees, or less than approximately 30 degrees. Further, in these embodiments, the loft angle of the club head 100 can be greater than approximately 12 degrees, greater than approximately 13 degrees, greater than approximately 14 degrees, greater than approximately 15 degrees, greater than approximately 16 degrees, greater than approximately 17 degrees, greater than approximately 18 degrees, greater than approximately 19 degrees, or greater than approximately 20 degrees. For example, in some embodiments, the loft angle of the club head 100 can be between 12 degrees and 35 degrees, between 15 degrees and 35 degrees, between 20 degrees and 35 degrees, or between 12 degrees and 30 degrees.

In embodiments where the club head 100 comprises a fairway wood, the volume of the club head 100 is less than approximately 400 cc, less than approximately 375 cc, less than approximately 350 cc, less than approximately 325 cc, less than approximately 300 cc, less than approximately 275 cc, less than approximately 250 cc, less than approximately 225 cc, or less than approximately 200 cc. In these embodiments, the volume of the club head 100 can be approximately 150 cc-200 cc, approximately 150 cc-250 cc, approximately 150 cc-300 cc, approximately 150 cc-350 cc, approximately 150 cc-400 cc, approximately 300 cc-400 cc, approximately 325 cc-400 cc, approximately 350 cc-400 cc, approximately 250 cc-400 cc, approximately 250 cc-350 cc, or approximately 275 cc-375 cc.

In some embodiments, the club head 100 can comprise a hybrid. In these embodiments, the loft angle of the club head can be less than approximately 40 degrees, less than approximately 39 degrees, less than approximately 38 degrees, less than approximately 37 degrees, less than approximately 36 degrees, less than approximately 35 degrees, less than approximately 34 degrees, less than approximately 33 degrees, less than approximately 32 degrees, less than approximately 31 degrees, or less than approximately 30 degrees. Further, in these embodiments, the loft angle of the club head 100 can be greater than approximately 16 degrees, greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, or greater than approximately 25 degrees.

In embodiments where the club head 100 comprises a hybrid, the volume of the club head 100 is less than approximately 200 cc, less than approximately 175 cc, less than approximately 150 cc, less than approximately 125 cc, less than approximately 100 cc, or less than approximately 75 cc. In some embodiments, the volume of the club head 100 can be approximately 100 cc-150 cc, approximately 75 cc-150 cc, approximately 100 cc-125 cc, or approximately 75 cc-125 cc.

The golf club head 100 comprises a sole 104, a crown (not pictured) opposite the sole 104, a toe 108, a heel 112 opposite the toe 108, a hosel 116, and a multicomponent weight system 120. A rear portion 124 of the sole 104 of the club head forms a cavity 128 that extends inward from an external contour of the sole 130. The multicomponent weight system 120 is configured to be positioned within and coupled to the cavity 128.

I. Cavity

Figure 2:
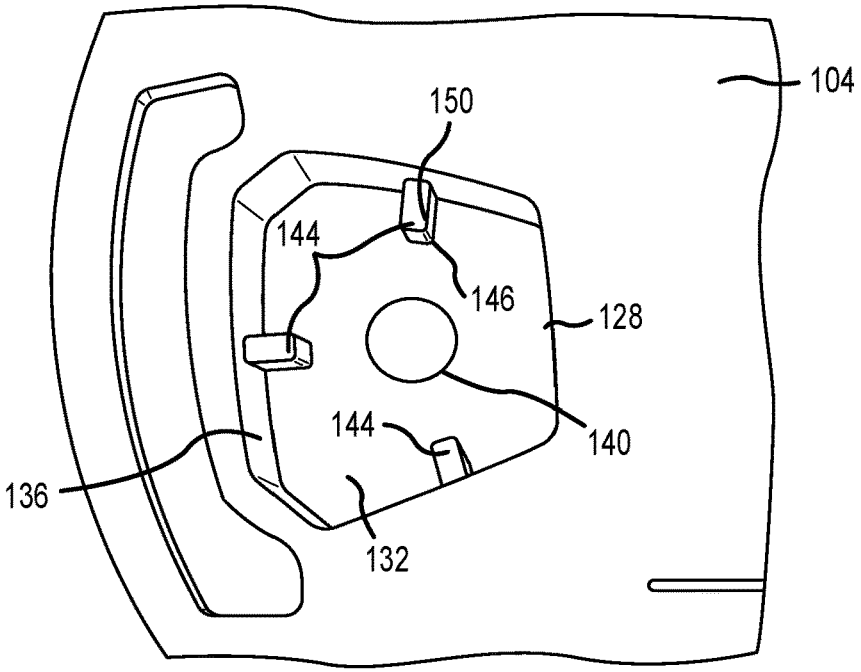
FIG. 2 illustrates an enlarged bottom view of the golf club head and weight system of FIG. 1, devoid of the weight.

Referring to FIG. 2, the cavity 128 of the club head 100 comprises a base 132, a side surface 136, a fixing aperture 140 extending inward from the base 132 of the cavity 128, and a one or more ribs 144 protruding from the side surface 136 of the cavity 128. In the illustrated embodiment, the cavity 128 comprises a trapezoidal shape. In other embodiments, the cavity 128 can comprise any shape. For example, the shape of the cavity 128 can comprise a circle, an ellipse, a triangle, a rectangle, an octagon, or any other polygon or shape with at least one curved surface.

The ribs 144 of the cavity 128 extend upward from the base 132 toward the external contour of the sole 130 from a first end 146, located near the base 132 of the cavity 128, to a second end 150, located near the external contour of the sole 130. In the illustrated embodiment, the first end 146 of the rib 144 is in contact with the base 132 of the cavity 128. Further, in the illustrated embodiment, the second end 150 of the rib 144 is offset from the external contour of the sole 130. In other embodiments, the first end 146 of the rib 144 can be offset from the base 132 of the cavity 128. Further, in other embodiments, the second end 150 of the rib 144 can contact the external contour of the sole 130. In the illustrated embodiment, the cavity 128 has three ribs 144. In other embodiments, the one or more ribs 144 can comprise any number of ribs 144, including one, two, three, four, or more ribs.

The ribs 144 have a height measured from the first end 146 near the external contour of the sole 130, to the second end 150 near at the base 132 of the cavity 128. In many embodiments, the height of the one or more ribs 144 can range from 0.125 inches to 0.175 inches. For example, the height of the one or more ribs 144 can range from 0.175 inches-0.225 inches, or 0.225 inches-0.275 inches. In one embodiment, the one or more ribs 144 can be approximately 0.175 inches-0.225 inches. The height of the one or more ribs 144 can be 0.175 inches, 0.180 inches, 0.185 inches, 0.190 inches, 0.195 inches, 0.200 inches, 0.205 inches, 0.210 inches, 0.215 inches, 0.220 inches, or 0.225 inches.

The cavity 128 includes a depth measured from the base 132 of the cavity 128 to the external contour of the sole 130, in a direction generally perpendicular to the base 132. In many embodiments, the depth of the cavity 128 is between 0.10 inches and 0.50 inches. In some embodiments, the depth of the cavity 128 is less than 0.50 inches, less than 0.45 inches, less than 0.40 inches, less than 0.35 inches, less than 0.30 inches, less than 0.25 inches, less than 0.20 inches, or less than 0.15 inches.

The fixing aperture 140 extends inward from the base 132 of the cavity 128 towards the crown of the club head 100. Further, the fixing aperture 140 of the cavity 128 comprises a diameter. In some embodiments, the fixing aperture 140 can comprise threading that mates with the threading of a fastener 156 to secure the multicomponent swing weight system 120 in the cavity 128. In other embodiments, the fixing aperture 140 can be devoid of threading for use with a self-tapping or self-drilling fastener.

II. Weight Member

Figure 3:
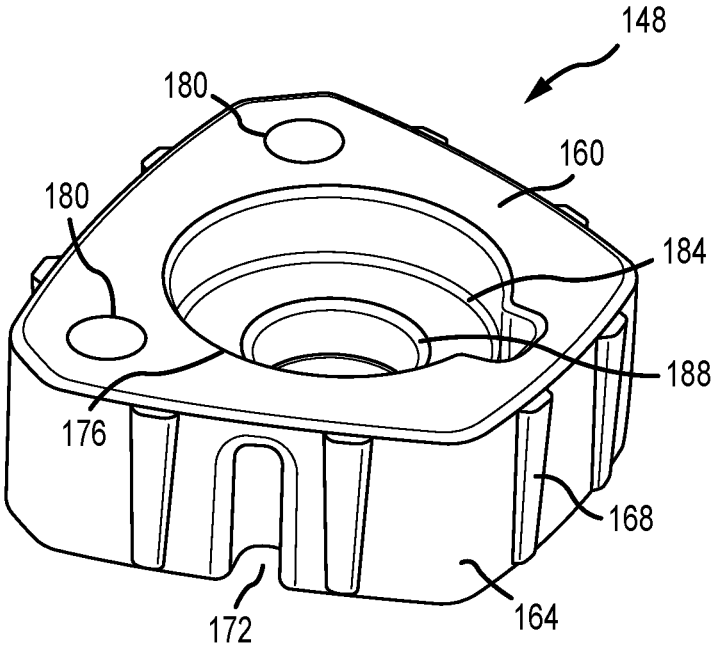
FIG. 3 illustrates a weight member included in the multicomponent weight system of the golf club head of FIG. 1.

As illustrated in FIG. 3, the weight member 148 of the multicomponent weight system 120 is configured to be positioned within the cavity 128 of the club head 100. In the illustrated embodiment, the weight member 148 is trapezoidal in shape to correspond to the shape of the cavity 128. In other embodiments, the weight member 148 can comprise any geometric shape corresponding to the shape of the cavity 128 (e.g., circular, elliptical, triangular, rectangular, trapezoidal, octagonal, or any other polygonal shape or shape with at least one curved surface).

The multicomponent weight system 120 comprises an upper surface 160, a lower surface (not pictured), and a side wall 164 extending between the upper surface 160 and lower surface. The upper surface 160 of the weight member 148 comprises a contour to match the external contour of the sole 130. In other embodiments, the upper surface 160 may comprise a flat surface. The side wall 164 circumscribes the perimeter of the upper surface 160 and/or the lower surface. The side wall 164 is oriented substantially perpendicular to the upper surface 160 and/or the lower surface. In the illustrated embodiment, the side wall 164 comprises four surfaces due to the trapezoidal shape of the weight member 148.

The side wall 164 has a height measured from the lower surface of the weight member 148 to the upper surface 160 of the weight member 148. In many embodiments, the height of the side wall 164 of the weight member 148 can be similar to or slightly less than the depth of the cavity 128.

The weight member 148 can further comprise one or more of the following; (1) one or more splines 168 protruding from the side wall 164; (2) one or more slits 172 inset within the side wall 168; (3) an aperture 176 extending entirely through the weight member 148 from the upper surface 160 to the lower surface; (4) at least one bore 180 located on the upper surface 160 of the weight member 148.

a. Splines

Referring to FIG. 3, the weight member 148 can comprise one or more splines 168 located on and protruding from the side wall 164 of the weight member 148. When the weight member 148 is positioned within the cavity 128 of the club head 100, the splines 168 are configured to abut the side surface 136 of the cavity 128 and the weight member 148. This abutment generates a press fit of the weight member 148 within the cavity 128.

In the illustrated embodiment, the side wall 164 has eight splines 168, including two splines 168 on each surface of the side wall 164. In other embodiments, the side wall 164 of the weight member 148 can comprise any number of splines 168 including, one, two, three, four, five, six, seven, eight, or more splines 168. In the illustrated embodiment, the splines 168 are evenly spaced along the side wall 164. In other embodiments, the splines 168 can be unevenly spaced or can comprise any spacing.

The one or more splines 168 comprise a length measured from an end of the spline 168 nearest to the upper surface 160 of the weight member 148, to an opposing end of the spline 168 nearest the lower surface of the weight member 148. In the illustrated embodiment, the length of the splines 168 is substantially the same as the height of the side wall 164. In other embodiments, the length of the splines 168 can be less than the height of the side wall 164.

Each spline 168 comprises a width measured in a direction generally parallel to the top or bottom surface, and to the side wall 164 of the weight member 148. In the illustrated embodiment, each spline 168 comprises approximately 3-10% of the length of one side of the trapezoidal weight member 148. Other embodiments can have different spline widths. In some embodiments, the width can be roughly 3%, 4%, 5%, 6%, 7%, 8%, 9%, or 10% of the length of one side of the weight member 148.

Each spline 168 comprises a height that is measured from an outermost edge of the spline 168 to the side wall 164 of the weight member 148, in a direction generally perpendicular to the sidewall 164. In many embodiments, the height of each spline 168 can range from 0.01 inches-0.30 inches. In some embodiments, the height of each spline 168 can range from 0.01 inches-0.05 inches, 0.05 inches-0.10 inches, 0.10 inches-0.15 inches, 0.15 inches-0.20 inches, 0.20 inches-0.25 inches, 0.25 inches-0.30 inches. Additionally, the height of each spline 168 can remain constant, or the height of each spline 168 can vary along the length of spline 168. In the illustrated embodiment, the height of each spline 168 is smaller closer to the lower surface, and the height is larger closer to the upper surface 160. In other embodiment, the height of the splines 168 can vary according to any profile (e.g. increase in a direction extending from the lower surface to the upper surface 160, increase in a direction extending from the upper surface 160 to the lower surface, or any combination thereof).

The splines 168 function to secure the weight member 148 within the cavity 128. The increasing height of each spline 168 along the length of each spline 168, creates a press fit with the side surface 136 of the cavity 128. As the weight member 148 is set into the cavity 128, the splines 168 abut the side surface 136 of the cavity 128 and the weight member 148. This abutment helps secure the weight member 148 in place within the cavity 128.

b. Slits

Referring to FIG. 3, the weight member 148 can comprise one or more slits 172 located on and inset from the side wall 164 of the weight member 148. The slits 172 are configured to receive the ribs 144 in the cavity 128 when the weight member 148 is positioned within the cavity 128 on the club head 100. Accordingly, the slits 172 comprise a cross-sectional shape corresponding to the cross-sectional shape of the ribs 144.

In the illustrated embodiment, the weight member 148 comprises three slits 172. In other embodiments, the one or more slits 172 can comprise any number of slits 172, including one, two, three, four, five, six, seven, eight or more slits 172. Each slit 172 has a height that extends from the lower surface towards the upper surface 160 of the weight member 148. In the illustrated embodiment, the slit 172 does not extend entirely to the upper surface 160 of the weight member 148. In other embodiments, the slit 172 can extend entirely to the upper surface 160 of the weight member 148.

Each slit 172 has a height that is measured from the lower surface to the upper surface 160 of the weight member 148. The height comprises between 50% and 100% of the height of the side wall 164. In some embodiments, the height of the slit 172 can comprise 50%-75%, 60%-80%, 70%-90%, or 80%-100%. The height of the slit 172 can range from 0.10 inches to 0.25 inches. For example, the height of the slit 172 can range from 0.10 inches-0.15 inches, 0.15 inches-0.20 inches, or 0.20 inches-0.25 inches. In one embodiment, the height of the slit 172 can be approximately 0.20 inches-0.25 inches. The height of the slits 172 is substantially similar to the height to the of the ribs 144, such that the slits 172 house the ribs 144 when the weight member 148 is positioned within the cavity 128.

Each slit 172 has a width that is measured from opposing edges of the slit 172 that are adjacent or in contact with the side wall 164. The width of the slit 172 can range from 0.03 inches to 0.20 inches. For example, the width of the slit 172 can range from 0.03 inches-0.05 inches, 0.05 inches-0.10 inches, 0.10 inches-0.15 inches, or from 0.15 inches-0.20 inches. The width of the slit 172 can be similar to or larger than the width of the rib 144, as the slits 172 correspond to or mate with the ribs 144 protruding from the side surface 136 of the cavity 128 when the weight member 148 is positioned within the cavity 128.

Each slit 172 corresponds to a rib 144 of the cavity 128. The slits 172 surround each rib 144 and provide visual references to ease the placement of the weight member 148 into the cavity 128. In addition, the slits 172 prevent the weight member 148 from rotating, shifting, or vibrating during installation or play.

c. Aperture

Referring to FIG. 3, the weight member 148, contains an aperture 176 extending entirely through the weight member 148, from the upper surface 160 to the lower surface. The aperture 176 of the weight member 148 comprises a first portion 184 having a first diameter, and a second portion 188 having a second diameter. In some embodiments, the first diameter of the first portion 184 can be from 0.20 inches, 0.25 inches, 0.30 inches, 0.35 inches, or 0.40 inches. In some embodiments the first diameter of the first portion 184 can range from 0.25 inches-0.30 inches, 0.30 inches-0.35 inches, or 0.35 inches-0.40 inches. In one embodiment, the first diameter of the first portion 184 can be approximately 0.30 inches-0.35 inches. The first diameter of the first portion 184 is located adjacent to the upper surface 160 of the weight member 148. Further, the first diameter of the first portion 184 of the aperture 176 extends along a portion of the height of the weight member 148 to the second portion 188 of the aperture 176.

The second portion 188 of the aperture is located adjacent to the lower surface of the weight member 148 and extends along a portion of the height of the weight member 148 to the first portion 184 of the aperture 176. The second diameter of the second portion 188 is smaller than the first diameter of the first portion 184. In some embodiments, the second diameter of the second portion 188 can be from 0.20 inches, 0.25 inches, 0.30 inches, 0.35 inches, or 0.40 inches. In some embodiments, the second diameter of the second portion 188 can range from 0.10 inches-0.15 inches, 0.15 inches-0.20 inches, 0.20 inches-0.25 inches, 0.25 inches-0.30 inches, 0.30 inches-0.35 inches, 0.35 inches-0.40 inches. In one embodiment, the second diameter of the second portion 188 ranges from 0.15 inches-0.20 inches.

The aperture 176 is configured to receive a fastener to secure the weight member 148 within the cavity 128. The aperture 176 allows for a fastener to pass through the center of the weight member 148 and affix to the threaded aperture 140 of the cavity 128.

d. Bore

Referring to FIG. 3, in many embodiments, the weight member 148 can comprise one or more bores 180. The one or more bores 180 can be located on the upper surface 160 of the weight member and can extend through a portion of the weight member defining a depth. In some embodiments, the one or more bores 180 can extend into the upper surface 160 of the weight member 148 by approximately 50% of the height of the weight member 148.

In the illustrated embodiment, the weight member 148 comprises two bores 180 including a first bore and a second bore. In other embodiments, the weight member 148 can comprise any number of bores 180. For example, the weight member 148 can comprise one, two, three, four, or more bores 180. Further, the depth of the one or more bores 180 can be between 0.05 inches and 0.20 inches. In some embodiments, the depth of the one or more bores 180 can be 0.05 inches-0.10 inches, 0.10 inches-0.15 inches, or 0.15 inches-0.20 inches. The depth of the one or more bores 180 can be 0.05 inches, 0.06 inches, 0.07 inches, 0.08 inches, 0.09 inches, 0.10 inches, 0.11 inches, 0.12 inches, 0.13 inches, 0.14 inches, 0.15 inches, 0.16 inches, 0.17 inches, 0.18 inches, 0.19 inches, or 0.20 inches.

The one or more bores 180 can be positioned in a number of locations on the weight member 148. The one or more bores 180 do not overlap with the aperture 176 of the weight member 148. The one or more bores 180 can provide a recess to house any feature of the cap 152, including posts 204 as discussed below.

III. Cap

Figure 4:
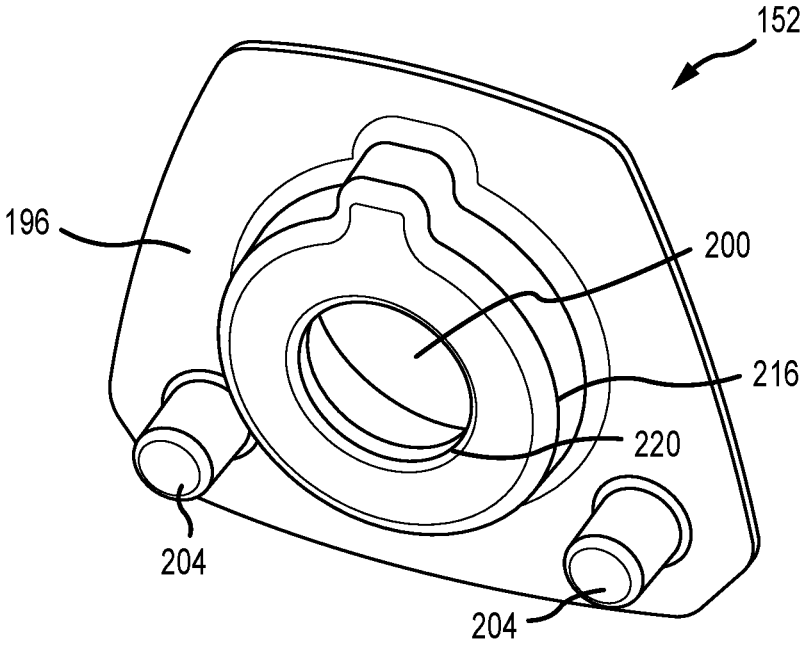
FIG. 4 illustrates a cap included in the multicomponent weight system of the golf club head of FIG. 1.
Figure 5:
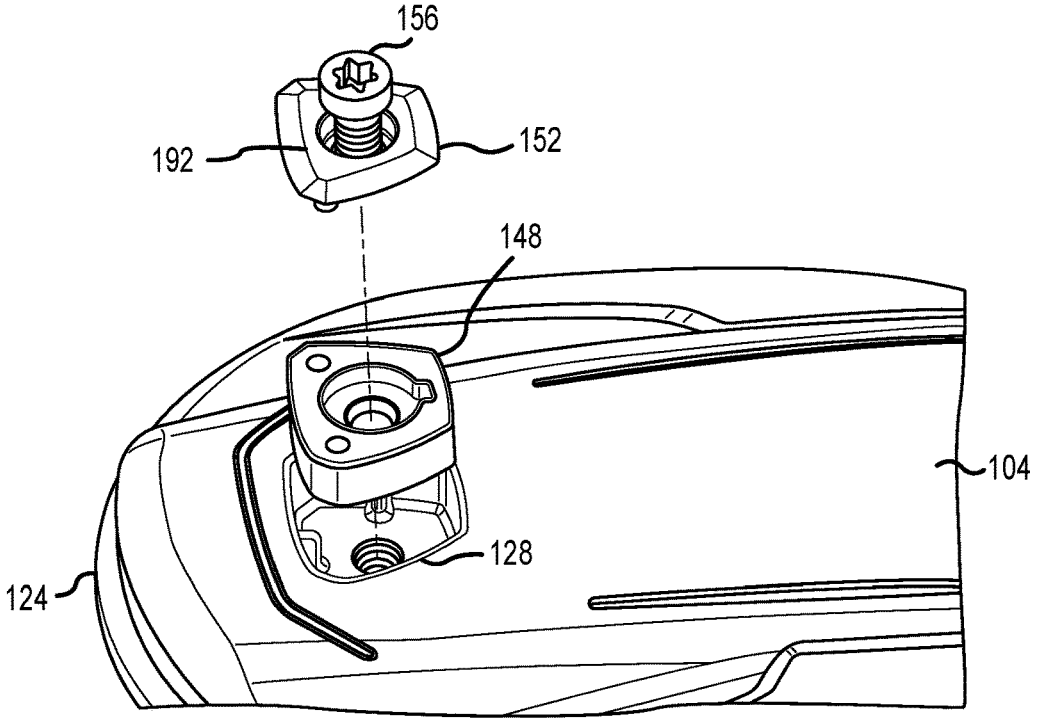
FIG. 5. illustrates an assembly of the multicomponent weight system of the golf club head of FIG. 1.
Figure 6:
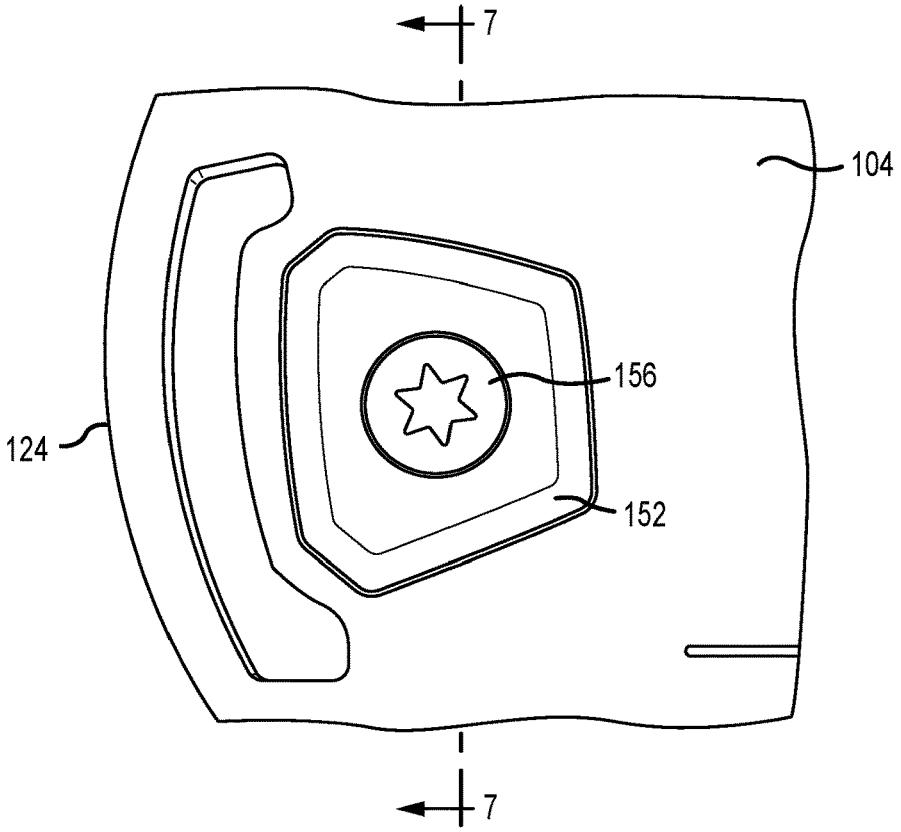
FIG. 6 illustrates an enlarged bottom view of the multicomponent weight system of FIG. 1.

Referring to FIGS. 4-6, the multicomponent weight system 120 comprises a cap 152 configured to be positioned over the weight member 148, within the cavity 128 of the club head 100. The cap 152 comprises an outer surface 192, flush with the external contour of the sole 130, an inner surface 196 opposite the outer surface 192, an aperture 200 extending through the outer surface 192 and inner surface 196, and one or more posts 204 protruding from the inner surface 196. The cap 152 is positioned on the upper surface 160 of weight member 148 to protect the weight member 148 from wear caused by repeated use and playing conditions (e.g., prevents dirt, grass, or water from getting into the cavity 128).

The cap 152 comprises a complementary geometric shape to the weight member 148. In the illustrated embodiment, the cap 152 is trapezoidal. In other embodiments, the cap 152 of the multicomponent weight system 120 can comprise any geometric shape (e.g., circular, triangular, rectangular, trapezoidal, octagonal, or any other polygonal shape, or shape with at least one curved surface).

The outer surface 192 of the cap 152 comprises a generally flat surface. The flat outer surface 192 of the cap 152 allows for the multicomponent weight system 120 to be flush with the external surface of the sole 104 when the multicomponent swing weight system 120 is coupled within the cavity 128. The contour of the inner surface 196 of the cap 152 is complementary to the contour of the upper surface 160 of the weight member 148. The inner surface 196 comprises a contour having a protruded surface that contains the aperture 200. The protruded surface is received by the first portion 184 of the aperture 176 of the weight member 148 when the cap 152 is positioned over the weight member 148 within the cavity 128.

There can be spacing between the external contour of the sole 130 and the cap 152. In many embodiments the spacing between the external contour of the sole 130 and the cap 152 can range from 0.06 inches-0.20 inches. In some embodiments, the spacing between the external contour of the sole 130 and the cap 152 can range from 0.06 inches-0.08 inches, 0.08 inches-0.10 inches, 0.10 inches-0.12 inches, 0.12 inches-0.14 inches, 0.14 inches-0.16 inches, 0.16 inches-0.18 inches, or 0.18 inches-0.20 inches. In one embodiment, the spacing between the external contour of the sole 130 and the cap 152 can be approximately 0.08 inches-0.10 inches.

a. Aperture

The aperture 200 is positioned generally in the center of the cap 152. The aperture 200 comprises a first portion 216 having a first diameter and a second portion 220 having a second diameter, wherein the first diameter of the first portion 216 is greater than the second diameter of the second portion 220. The first portion 216 of the aperture 200 is located adjacent to the outer surface 192 and extends through a portion of the cap 152 to the second portion 220. The second portion 220 of the aperture 200 is located adjacent to the inner surface 196 and extends through a portion of the cap 152 to the first portion 216.

In many embodiments, the first diameter of the first portion 216 can range from 0.25 inches-0.35 inches. In some embodiments, the first diameter of the first portion 216 can range from 0.25 inches-0.30 inches, or 0.30 inches-0.35 inches. In one embodiment, the first diameter of the first portion 216 can be approximately 0.30 inches-0.35 inches.

The second diameter of the second portion 220 of the aperture 200 is substantially similar in size to the second diameter of the second portion 188 of the weight member 148. In many embodiments, the second diameter of the second portion 220 can range from 0.10 inches-0.35 inches. In some embodiments, the second diameter of the second portion 220 can range from 0.10 inches-0.15 inches, 0.15 inches-0.20 inches, 0.20 inches-0.25 inches, 0.25 inches-0.30 inches, or 0.30 inches-0.35 inches. In one embodiment, the second diameter of the second portion 220 ranges from 0.15 inches-0.20 inches.

b. Posts

As illustrated in FIG. 5, the one or more posts 204 extend from the inner surface 196 and comprise a shape corresponding to the one or more bores 180 in the weight member 148, thereby enabling a press fit or interference fit of the cap 152 to the weight member 148. In many embodiments, the posts 204 comprise a height measured in a direction perpendicular to the inner surface 196. The post height can range from 0.05 inches-0.15 inches. In some embodiments, the post height can range from 0.05 inches-0.10 inches, or 0.10 inches-0.15 inches. The post height can be 0.05 inches, 0.06 inches, 0.07 inches, 0.08 inches, 0.09 inches, 0.10 inches, 0.11 inches, 0.12 inches, 0.13 inches, 0.14 inches, 0.15 inches, 0.16 inches, 0.17 inches, 0.18 inches, 0.19 inches, or 0.20 inches. In one embodiment, the posts 204 ranges from 0.10 inches-0.15 inches. In other embodiments, the cap 152 can be devoid of the one or more posts 204.

III. Fastener

The multicomponent weight system 120 comprises a fastener 156 capable of securing the weight member 148 and the cap 152 within the cavity 128 of the club head 100. The fastener 156 comprises a head portion 208 and a body portion 212. The fastener 156 can be positioned through the aperture 200 of the cap 152 and the aperture 176 of the weight member 148 and fixed to the aperture 200 of the cavity 128 to secure the multicomponent weight system 120 to the club head 100.

The head portion 208 comprises a receiving geometry, wherein the receiving geometry can engage a fastening tool. The body portion 212 of the fastener 156 extends from the head portion 208 of the fastener 156. The body portion 212 comprises geometry that mates with the geometry of the second portion 188 of the aperture 176 of the weight member 148, the second portion 220 of the aperture 200 of the cap 152, and the aperture 140 of the cavity 128. When assembled, the first portion of the aperture 200 of the cap 152 can house the head portion 208 of the fastener 156. The second portion 220 of the aperture 200 of the cap 152 and the second portion 188 of the aperture 176 of the weight member 148 can house the body 212 of the fastener 156.

The head portion 208 of the fastener 156 comprises a first diameter 232 and the body portion 212 of the fastener 156 comprise of a second diameter 236. The first diameter 232 of the head portion 208 is greater than the second diameter 236 of the body portion 212. The first diameter 232 of the head portion 208 of the fastener 156 is substantially similar to the first diameter of the first portion 216 of the cap 152. In many embodiments, the first diameter 232 of the head portion 208 can range from 0.20 inches-0.40 inches. In some embodiments, the first diameter 232 can range from 0.10 inches-0.15 inches, 0.15 inches-0.20 inches, 0.20 inches-0.25 inches, 0.25 inches-0.30 inches, 0.30 inches-0.35 inches, or 0.35 inches-0.40 inches. In one embodiment, the first diameter 232 can be approximately 0.30 inches-0.35 inches. The head portion 208 of the fastener 156 is housed in the first portion 216 of the aperture of the cap 152.

The second diameter 236 of the body portion 212 of the fastener 156 is substantially similar to the second diameter 220 of the cap 152 and the second diameter 188 of the weight member 148. In many embodiments, the second diameter 236 can range from 0.10 inches-0.30 inches. In some embodiments, the second diameter 236 can range from 0.10 inches-0.15 inches, 0.15 inches-0.20 inches, 0.20 inches-0.25 inches, or 0.25 inches-0.30 inches. In one embodiment, the second diameter 236 ranges between 0.15 inches and 0.20 inches. The body portion 212 of the fastener 156 is housed in the second portion 220 of the cap 152, the second diameter of the second portion 188 of the weight member 148, and the aperture 140 of the cavity 128.

The fastening tool can tighten or loosen the fastener 156 of the multicomponent weight system 120. In one embodiment, the fastening tool can be a torque wrench. When the fastener 156 is placed through the aperture 200 of the cap 152 and the aperture 176 of the weight member 148 and inserted into the fixing aperture 140 of the cavity 128, the fastening tool can be used to affix the fastener 156 to the aperture of the cavity 128, thus securing the multicomponent weight system 120 to the golf club head 100. In one embodiment, the fastener 156 can be inserted into the fixing aperture 140 of the cavity 128 and can be turned with a toque wrench, wherein an audible click confirms that the multicomponent weight system 120 is affixed to the golf club head 100.

IV. Assembly

Figure 7A:
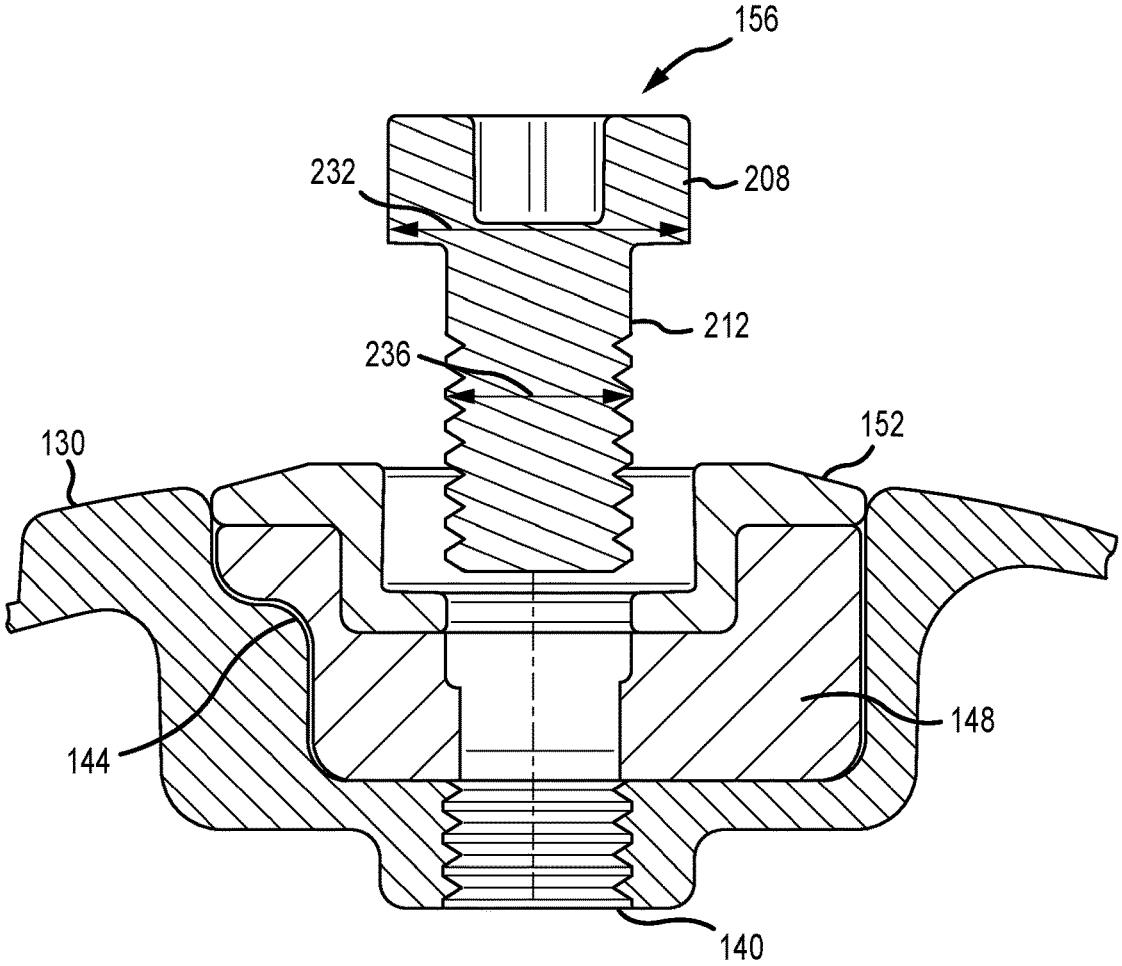
FIG. 7*a* illustrates a cross-section view of the assembly of the multicomponent weight system of FIG. 5.
Figure 7B:
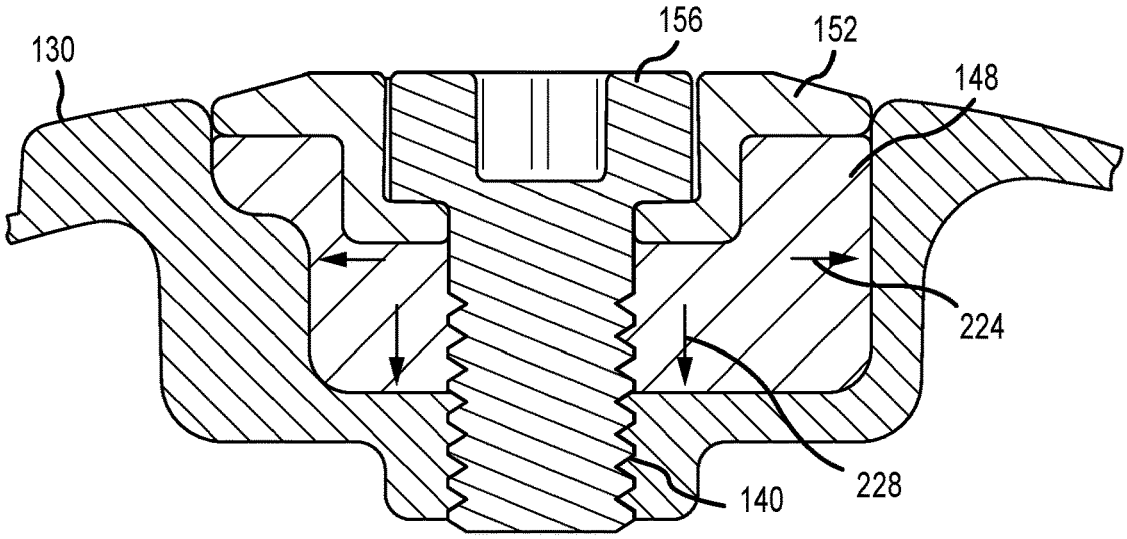
FIG. 7*b* illustrates another cross-section view of the assembly of the multicomponent weight system of FIG. 5.

As illustrated in FIGS. 5-7, the multicomponent weight system 120 is assembled to the club head 100 within the cavity 128. The multicomponent weight system 120 is positioned within the cavity 128 on the sole 104 of the club head 208 such that the cap 152 and the fastener 156 are flush with the external surface of the sole 104, and there is no gap between the weight member 148 and side surface 136 of the cavity 128 of the sole 104.

To assemble the multicomponent weight system 120 to the club head 100, the weight member 148 is placed in the cavity 128 of the club head 100. The cap 152 is then placed overtop the weight member 148, and the fastener 156 is placed through the cap 152 and the weight member 148, and into the fixing aperture 140 of the cavity 128. The fastener 156 is then tightened, completing the assembly of the multicomponent swing weight system 120.

In the illustrated embodiment, when the weight member 148 is positioned within the cavity 128, the splines 168 of the weight member 148 contact the side surface 136 of the cavity 128, and the ribs 144 of the cavity 128 align with the slits 172 of the weight member 148. When the cap 152 is positioned over the weight member 148, the protruded inner surface 196 aligns with the first portion 184 of the aperture 176 of the weight member 148, and the posts 204 align with the bores 180 of the weight member 148. Further, when the fastener 156 is positioned through the cap 152 and the weight member 148 and into the aperture 140 of the cavity 128, the head portion 208 of the fastener 156 sits within the first portion 216 of the aperture 200 of the cap 152, and the body portion 212 of the fastener 156 extends through the aperture 200 of the cap, the aperture 176 of the weight member 148, and the aperture 140 of the cavity 128. Specifically, the body portion 212 of the fastener 156 contacts the second portion 220 of the aperture 200 of the cap, the second portion 188 of the aperture 176 of the weight member 148, and the aperture 140 of the cavity 128.

V. Materials

The weight member 148 can be made of any material, such as metals, polymers (e.g. thermoplastic polyurethane, thermoplastic elastomer), composites, or any combination thereof. The weight member 148 can be a polymer injection molded with different quantities of a high-density material (e.g. metal powder) or materials of different densities, to achieve weight members 148 of varying mass, while maintaining the same volume. Injection molded weight members 148 with different densities allow for a wide range of weight members 148 with an identical volume and geometric shape.

The volume, V, of an object can be calculated by Equation 1 below, wherein m is the mass of an object, and p is the density of an object. Mass and density are directly related. For example, if the volume is constant and the mass increases, then the density also increases. If the volume is constant and the mass decreases, then the density also decreases.

$$V = \frac{m}{\rho} \tag{1}$$

The weight member 148 can have a constant volume, while changing the density of the material to increase the mass. In many embodiments the density of the weight member 148 ranges from 1.7 g/cc-10.8 g/cc. In some embodiments the density of the weight member 148 ranges from 1.7 g/cc-4.2 g/cc, 4.3 g/cc-6.7 g/cc, 6.8 g/cc-9.2 g/cc, or 9.3 g/cc-10.8 g/cc.

In many embodiments, the mass of the weight member 148 ranges between 2.0 g and 30.0 g. In some embodiments, the mass of the weight member 148 ranges from 2.0 g-4.0 g, 4.0 g-6.0 g, 6.0 g-8.0 g, 8.0 g-10.0 g, 10.0 g-12.0 g, 12.0 g-14.0 g, 14.0 g-16.0 g, 16.0 g-18.0 g, 18.0 g-20.0 g, 22.0 g-24.0 g, 24.0 g-26.0 g, 26.0 g-28.0 g, 28.0 g-30.0 g. The mass of the weight member 148 can be 2 g, 3 g, 4 g, 5 g, 6 g, 7 g, 8 g, 9 g, 10 g, 11 g, 12 g, 13 g, 14 g, 15 g, 16 g, 17 g, 18 g, 19 g, 20 g, 21 g, 22 g, 23 g, 24 g, 25 g, 26 g, 27 g, 28 g, 29 g, or 30 g.

In the illustrated embodiment, the weight member 148 comprises thermoplastic polyurethane (TPU). The TPU material allows for the weight member 148 to be compressed against the base 132 and side surface 136 of the cavity 128 when the downward force 228 of the fastener 156 is applied. This compression creates a press seal, preventing water, debris, or dirt from entering into the cavity 128 from the side surface. The TPU weight member 148 is further compressed as the fastener 156 passes through the through hole of the weight member 148. The body portion 212 of the fastener 156 interacts with the weight member 148, creating a seal within the aperture 176, which prevents water or debris from entering the cavity 128 from the fastener 156 entry.

The durometer of a material measures the hardness of the material. In many embodiments, the material of the weight member 148 can have durometer range between 40D and 80D. In some embodiments, the durometer range can be between 55D and 75D. These durometers are optimal as they provided the desired amount of compression and rigidity. If the durometer is too low, the weight member 148 can be over compressed, compromising the structural integrity and causing the weight system to compress below the external sole contour 130. If the durometer is too high, the weight system 120 does not compress, and there is no seal, or a poor seal created at the base 132 and side walls 136 of the cavity 128.

The cap 152 can be made of metals such as steel, tungsten, aluminum, titanium, vanadium, chromium, cobalt, nickel, other metals, metal alloys, plastics, composites, or any combination thereof. For example, the cap 152 can be made of either 304SS or 6061-Al. Further still, the cap 152 may comprise a physical vapor deposition (PVD) or type II anodized finish, which can prevent grass, dirt, and debris from getting stuck in between the cavity 128 and the multicomponent weight system 120. The PVD and type II anodized finish improves the wear performance of the sole 104 and the aesthetic appeal of the club head 100.

The fastener 156 can be made of metals such as steel, stainless steel, tungsten, aluminum, nickel, other metals, metal alloys, or any combination thereof. For example, the fastener 156 can be made of 303SS or 304SS. Further, the fastener 156 may comprise a conversion coating to add corrosion resistance and minimize light reflection. For example, the conversion coating can be a black oxide coating.

VI. Benefits

The multicomponent weight system 120 allows a manufacturer to form weights of different mass, while maintaining a constant volume. As manufacturers create denser weight members, weight members become more brittle, often causing the weight members to crack or break over time. However, through the combination of the cap 152, the fastener 156, and the ribs 144 within the cavity 128, if a weight member 148 cracks it will not compromise the moment of inertia (MOI) and center of gravity (CG) properties within the golf club head 100, since the weight member 148 will not move within or fall out of the cavity 128. The multicomponent weight system 120 allows the manufacturer to couple a wide range of weight members 148 of different densities to the same golf club head 100, while preventing any material breakdown or cracking of dense weight portions. Further, the multicomponent weight system 120 allows the manufacturer to couple a wide range of weight members 148 of different densities to the same golf club head 100, while maintaining a similar aesthetic appearance for each golf club head 100 and optimizing CG and MOI.

Further, the cavity 128 can be reduced in size and be positioned further back on sole 104 of the golf club head 100 compared to current swing weight systems. Since the weight member 148 can be made extremely dense, without concern for the weight member 148 becoming brittle and cracking, the multicomponent weight system 120 can have a smaller profile than current swing weight systems. A smaller profile allows the multicomponent weight system 120 to be placed closer to the perimeter of the club head 100, thus improving CG position. Further, reducing the amount of internal structural mass used to support the multicomponent weight system 120 in the sole 104 allows additional mass to be positioned in other locations of the club head 100 to further increase club head MOI. The increased MOI leads to increased directional forgiveness of the club head 100 for off centered hits, thus improving the overall performance of the golf club head 100.

The slits 172 and ribs 144 provide visual references to ease placement of the weight member 148 into the cavity 128. The slits 172 surround the ribs 144 when the weight member 148 is placed in the cavity 128. When the weight member experiences a force, the ribs 144 contact the slits 172, thus preventing any rotation or movement. The combination of one or more slits 172 on the weight member 148, with the one or more ribs 144 in the cavity 128 prevents the multicomponent weight system 120 from shifting, rotating, or vibrating during installation and/or play. Further still, the geometry of the splines 168 securely wedges the multicomponent weight system 120 into the cavity 128. The series of splines 168 ensures that the multicomponent weight system 120 will not rotate or shift during installation and/or play by providing an outward force 224 onto the side surface 136 of the cavity 128. The increasing height of each spline 168 along the length of each spline 168, creates a press fit with the side wall 168 of the cavity 128. As the weight member 148 is set into the cavity 128, the splines contact the side wall 168. This contact creates an outward force 224, which helps secure the weight member 148 in place within the cavity 128. As the cap 152 is attached, and the fastener 156 is gradually fixed, the weight member 148 is further forced down into the cavity 128 by a downward force 228. As the weight member 148 is forced down into the cavity 128, the part of the spline 168 with the largest height contacts the side wall 164, thus providing an outward force 224 on the side wall 164, and further securing the multicomponent weight system 120 in place.

The multicomponent weight system 120 is able to prevent rotation of the weight member 148 within the cavity 128, due to combination of the slits 172, ribs 144, and/or splines 168. The weight member 148 can thus be manufactured without the need for tight tolerances, since the slits 172, ribs 144, and/or splines 168 provide a tight fit of the multicomponent weight system 120 within the cavity 128. Reduced manufacturing tolerances reduce manufacturing costs of the multicomponent weight system 120 compared to weight systems devoid of one or more of the described features.

When the downward force 228 of the fastener 156 is applied through the cap 152, the material of the weight member 148 is compressed against the base 132 and side surface 136 of the cavity 128. The compression of the fastener 156 and cap 152 on the upper surface 160 of the weight member 148 creates a press seal, preventing water, debris, or dirt from entering into the fixing aperture 140 or the side surface 136. This press seal combined with the ribs 144, slits 172, and splines 168, improve the wear characteristics of the golf club head 100 by providing a water-resistant seal on the base 132 of the cavity 128. This seal improves the longevity of the golf club head 100, by preventing water from entering the interior of the club head 100. This press seal prevents corrosion of the golf club head 100. The multicomponent weight system 120 achieves a watertight seal, without intricate and costly machining techniques.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a driver-type golf club, the apparatus, methods, and articles of manufacture described herein may be applicable to other types of golf club such as a fairway wood-type golf club, a hybrid-type golf club, an iron-type golf club, a wedge-type golf club, or a putter-type golf club. Alternatively, the apparatus, methods, and articles of manufacture described herein may be applicable other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Various features and advantages of the disclosure are set forth in the following claims.

The invention claimed is:

1. A multicomponent weight system for a golf club head, the system comprising:

a weight member;

a cap;

and a threaded fastener;

wherein the weight member comprises an upper surface, a lower surface, a side surface, one or more splines, one or more slits, a weight member aperture;

wherein the side surface is oriented substantially perpendicular to the upper surface and the lower surface, and wherein the side surface further circumscribes a perimeter of the upper surface and the lower surface, extending between the upper surface and the lower surface;

wherein the cap comprises a cap aperture;

wherein the fastener comprises a head portion and a body portion;

wherein the body portion of the threaded fastener threading is chosen from a group consisting of machine threading, self-tapping threading, and self-drilling threading;

wherein the weight member aperture of the weight member extends entirely through the weight member, from the upper surface to the lower surface;

wherein the cap aperture of the cap aligns with the weight member aperture;

wherein the body of the fastener extends through the cap aperture and the weight member aperture, to bind the weight member, cap, and fastener together, to form the multicomponent weight system;

wherein the one or more splines are located on and protruding from the side surface of the weight member;

wherein the one or more slits are located on and inset from the side surface of the weight member;

wherein the cap and weight member are polygonal in shape.

2. The multicomponent weight system of claim 1, wherein the aperture of the cap comprises a first portion with a first diameter and a second portion with a second diameter, wherein the first diameter is greater than the second diameter.

3. The multicomponent weight system of claim 2, wherein the first diameter of the first portion of the aperture of the cap ranges from 0.30 inches-0.35 inches and the second diameter of the second portion of the aperture of the cap ranges from 0.15 inches 0.20 inches.

4. The multicomponent weight system of claim 2, wherein the head portion of the fastener fits in the first portion of the cap and the body portion of the fastener fits in the second portion of the cap, wherein the head portion does not fit in the second portion of the cap.

5. The multicomponent weight system of claim 4, wherein a receiving geometry of the head portion of the fastener can couple to a fastening tool.

6. The multicomponent weight system of claim 1, wherein the one or more splines have a height ranging from 0.20 inches 0.25 inches.

7. The multicomponent weight system of claim 1, wherein a mass of the weight member ranges between 2.0 g and 30.0 g.

8. The multicomponent weight system of claim 1, wherein the one or more slits have a height ranging from 0.20-0.25 inches and a width ranging from 0.05 inches-0.06 inches.

9. The multicomponent weight system of claim 1, wherein a density of the weight member ranges from 1.7 g/cc-10.8 g/cc.

10. A golf club head comprising:

a body comprising a face portion, a sole portion, a crown portion, a toe portion, a heel portion, a hosel portion;

a cavity in the sole portion;

a multicomponent weight system;

wherein the cavity in sole of the golf club comprises a side surface of the cavity, a fixing aperture, and one or more ribs;

wherein the ribs of the cavity protrude from the side surface of the cavity;

wherein the multicomponent weight system comprises a weight member, a cap, and a threaded fastener, wherein the weight member comprises an upper surface, a lower surface, a side surface, one or more splines, one or more slits, and a weight member aperture;

wherein the side surface is oriented substantially perpendicular to the upper surface and the lower surface;

wherein the cap comprises a cap aperture;

wherein the threaded fastener comprises a head portion and a body portion;

wherein the body portion of the threaded fastener threading is chosen from a group consisting of machine threading, self-tapping threading, and self-drilling threading;

wherein the weight member aperture of the weight member extends entirely through the weight member, from the upper surface to the lower surface;

wherein the cap aperture of the cap aligns with the weight member aperture of the weight member;

wherein the body of the threaded fastener extends through the cap aperture of the cap and the weight member aperture to bind the weight member, cap, and fastener together, to form the multicomponent weight system;

wherein the one or more splines are located on and protruding from the side surface of the weight member;

wherein the one or more slits are located on and inset from the side surface of the weight member; and wherein the multicomponent swing weight aligns with the cavity in the sole, the slits align with the ribs of the cavity, the splines of the weight portion contact the side surface of the cavity, and the shaft of the fastener extends through the aperture of the cap, the first aperture, and is removably secured to the aperture of the cavity;

wherein the weight member of the multicomponent weight system is polygonal in shape to correspond to a shape of the cavity in the sole, the slits in the weight member contact the ribs on at least two sides, and the splines of the weight member contact the side surface of the cavity, thus creating no gaps between the multicomponent weight system and the side surface of the cavity.

11. The golf club head of claim 10, wherein the depth of the cavity can range from 0.225 inches-0.275 inches.

12. The golf club head of claim 10, wherein the one or more ribs of the cavity has a height range of approximately 0.175 inches-0.225 inches.

13. The golf club head of claim 10, wherein the weight member comprises thermoplastic polyurethane (TPU).

14. The golf club head of claim 10, wherein a mass of the weight member ranges between 2.0 g and 30.0 g.

15. The golf club head of claim 10, wherein a density of the weight member ranges from 1.7 g/cc-10.8 g/cc.

16. The golf club head of claim 10, wherein the cap can be made of either 304 stainless steel or 6061 aluminum.

17. The golf club head of claim 10, wherein a loft angle of the club head can be less than approximately 35 degrees.

* * * * *